United States Patent [19]

Walker

[11] 4,364,495

[45] Dec. 21, 1982

[54] GARMENT STRETCHER

[76] Inventor: Alice R. Walker, Rte. 1, Box 279 B, Ocean City, Md. 21842

[21] Appl. No.: 156,844

[22] Filed: Jun. 5, 1980

[51] Int. Cl.[3] ..... A41H 5/00

[52] U.S. Cl. ..... 223/61; 223/69

[58] Field of Search ..... 223/61, 68, 69, 70, 223/71

[56] References Cited

U.S. PATENT DOCUMENTS

| | | | |
|---|---|---|---|
| 604,122 | 5/1898 | O'Thayne | 223/69 |
| 798,547 | 8/1905 | Walsh | 223/61 |
| 1,052,426 | 2/1913 | Ringler | 223/69 |
| 2,122,432 | 7/1938 | Maschke | 223/69 |
| 2,138,866 | 12/1938 | Lafargue | 223/69 |
| 2,746,657 | 5/1956 | Feathers | 223/69 |
| 2,929,538 | 3/1960 | Douglass | 223/69 |

*Primary Examiner*—Louis Rimrodt

*Attorney, Agent, or Firm*—John W. Huckert

[57] ABSTRACT

The garment extender is used to stretch and size tubular portions of garments. The extender comprises three longitudinal bars, namely a first side bar, an intermediate bar, and a second side bar. The first side bar and the intermediate bar are fixedly spaced and secured to each other by vertically spaced cross bars. These cross bars have a row of engaging means on their upper surface. The second side bar has similarly spaced cross bars which are secured at one end to the second side bar and having a depending interengaging member at their other end adapted to interengage with any of the row of engaging means on the upper surface of the first-mentioned cross bars. The free end of these second-mentioned cross bars extend through openings in the intermediate longitudinal bar and may slide therethrough to provide a lateral adjustment of the second side bar with respect to the first two, and in doing so to accommodate garments of varying widths.

7 Claims, 5 Drawing Figures

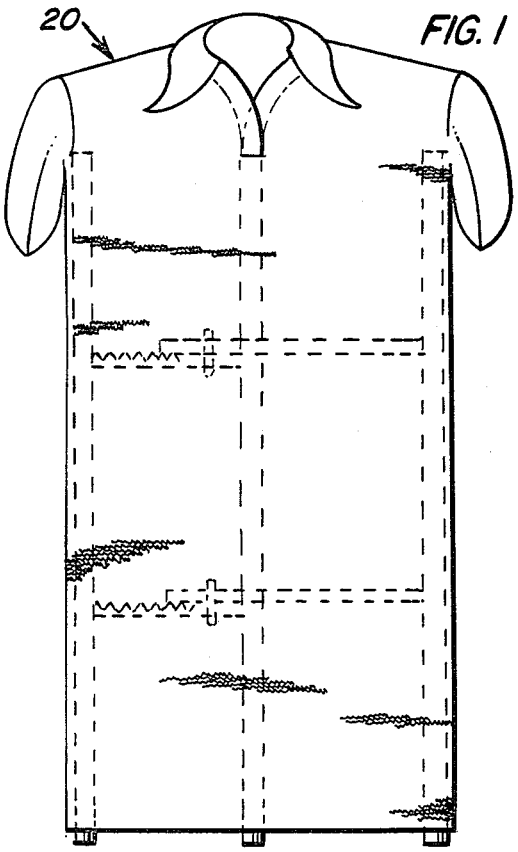
FIG. 1
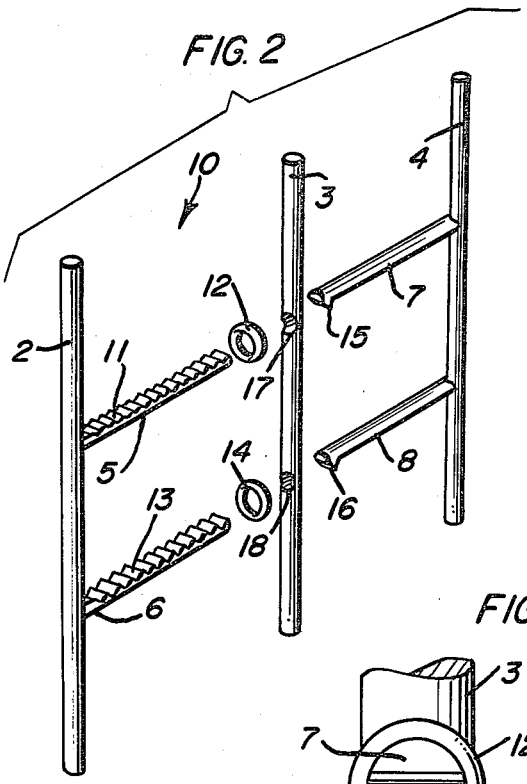
FIG. 2
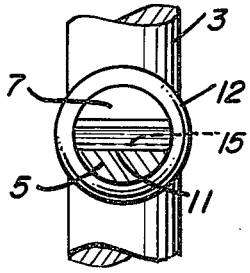
FIG. 4
FIG. 3
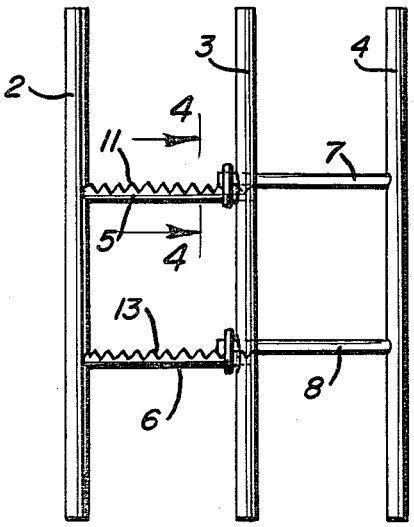
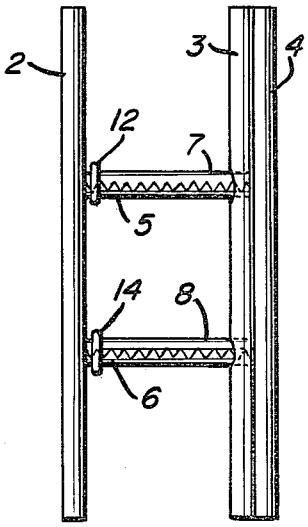
FIG. 5

GARMENT STRETCHER

BACKGROUND OF THE INVENTION

1. Field of the Invention

This invention relates generally to a garment stretcher, to be used with knit, crocheted or woven dampened garments in order to retain their size and shape while drying.

2. Description of the Prior Art

| | | | |
|---|---|---|---|
| O'Thayne | 604,122 | May 17, 1898 | 223-69 |
| Walsh | 798,547 | Aug. 29, 1905 | 223-61 |
| Ringler | 1,052,426 | Feb. 4, 1913 | 223-69 |
| Feathers | 2,746,657 | May 22, 1956 | 223-69 |
| Douglass | 2,929,538 | March 22, 1960 | 223-69 |

O'Thayne discloses a garment distender and drier frame having three longitudinal tubular rods or bars, connected by cross bars, and lateral adjustment means, see FIG. 2 of the drawings and lines 86–100 in the specification.

Walsh, Ringler and Douglass all disclose garment frames having lateral adjustment means comprising overlapping bars, with a series of adjustable and interconnectable fastenings held in position by means of rings, bands or the equivalent.

The patent to Feathers discloses a stretcher made of noncorrosive plastic or plated material.

The present device differs from the prior art in that it has fewer and simpler parts more directly related to each other. This results in being easier and more economical to make, simpler to use, more handily stored, and more adaptable to being used with garments of differing materials and varying configuration.

SUMMARY OF THE INVENTION

The prime objective of the present garment stretcher is to prevent shrinkage in garments and to help retain the original size and shape of the garment after washing.

By using such a stretcher the front and back portions of the garment are spaced from each other to hasten drying and prevent colors from running and bleeding.

Because the parts of the stretcher are few and simple, it is economical to manufacture and easy to handle in use. The device breaks down for storing and takes little space. It is lightweight, balanced, compact and may be carried in one hand. It is smooth and will neither snag nor stain the garment. The present stretcher is applicable to a wide range of garment sizes and shapes, as well as fabrics. The device has been designed to fit within a tubular body portion of a garment, such as a skirt, shirt or dress but may be applicable to a sleeve or pant leg as well.

The popularity of natural fibers and knit materials as cotton and wool, which are affected by heat and highly susceptible to shrinkage, makes the use of this stretcher highly desirable. On the other hand, the so-called permanent press woven and knit materials, which for the fastidious person are not sufficiently wrinkle-free but require light pressing or touchup, would also benefit from the use of the present stretcher. The stretcher when applied to a dampened permanent press garment would enhance drying while preventing wrinkling and thus avoid all ironing.

For needlepersons the present stretcher would serve to size knits and crochets which ordinarily tend to become distorted or pulled out of shape during their creation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a front view of the stretcher within a garment.

FIG. 2 is a perspective view of the stretcher parts disassembled.

FIG. 3 is a front view of the stretcher in its most extended position.

FIG. 4 is a cross-sectional view taken on line 4—4 of FIG. 3.

FIG. 5 is a front view of the stretcher in closed position as for storing.

DESCRIPTION OF THE PREFERRED EMBODIMENT

Referring more specifically to the drawings, numeral 10 is used to generally designate the garment stretcher. Longitudinal bars 2, 3 and 4 respectively may be either of tubular construction or of solid rod-like structure. The first two longitudinal bars 2 and 3 are held in fixedly spaced relation by cross bars 5 and 6 as shown in FIG. 3. These bars have a series of stepped adjustment means 11, 13 respectively on their upper surface extending from one end of the bar to the other. The incremental spaces between these steps is of the order of ½ inch. The third longitudinal bar 4 has cross bars 7 and 8 permanently attached at one end and spaced apart the same vertical distance as cross bars 5 and 6. These cross bars 7 and 8 have depending detent members 15, 16 respectively at their free end which are adapted to engage with the step adjustment means 11, 13 on bars 5 and 6. Loops or bands 12, 14 ride permanently on cross bars 5 and 6 and hold the depending members in locked relationship with the step adjustment means. The intermediate longitudinal bar 3 has openings 17 and 18 (see FIG. 2) spaced apart the same vertical distance as cross bars 7 and 8 are from each other. The cross bars 7 and 8 extend through openings 17 and 18, and overlie bars 5 and 6, with the detent depending members engaging with the series of step adjustment means to provide lateral adjustment for the stretcher. In FIG. 3 the stretcher is shown at its greatest lateral extent. In FIG. 5 the stretcher is shown at its minimum lateral extension or closed position, in which position it may be easily picked up, handled and stored.

All parts of the stretcher are made of plastic or plastic coated materials so that when it contacts the dampened garments it will neither snag nor stain the material. The stepped adjustment means which have been illustrated in this device as a series of indentations or teeth may also be made of plastic. Since this portion of the stretcher does not contact the garment, these indentations may be cast of metal or be metal capped to ensure a more positive engagement with the depending detent member, which may similarly be made of metal or plastic. The bands or loops 12 and 14 are preferably of such a size, and/or of such a resilient material as to exert a compressive force when bar 7 overrides bar 5, and bar 8 overrides bar 6 to hold them in fixed position, as shown in the cross-sectional view of FIG. 4. Cross bar 5 is complementary to bar 7, as is cross bar 6 to bar 8, each set of overlapping bars forming a cylindrical configuration as shown in FIGS. 2 and 4.

In FIG. 1 of the drawings the stretcher is shown applied to a knit garment, and it extends from beneath the armhole of the garment to the hem. The garment may be machine washed and spun dry or hand washed and presented dampened for stretching and sizing. The longitudinal rods of the stretcher are grasped and the stretcher is inserted into the body of the garment in its closed position, as shown in FIG. 5. Then the lateral adjustment is made to provide the necessary stretch to the garment. The outer bars 2 and 4 are separated drawing bar 7 over its complementary cross bar 5, and cross bar 8 over its complementary cross bar 6 until the outer longitudinal bars engage the periphery of the garment with sufficient stress. The depending detent means, 15 and 16 are cooperatively engaged with the stepped adjustment means 11, and 13 respectively and the loops 12 and 14 are drawn over the complementary bars to provide a tight and positive engagement.

While a particular step adjustment means has been illustrated in the form of indentations, it is obvious that all equivalent means presently available such as perforations, and notches could be substituted and the depending detent could be spring-operated in the known manner.

Insofar as the cross bars are concerned, the number of sets of complementary bars are optional; one would serve as would three. The pair of overlapping cross bars as shown in the drawing are preferably equidistantly spaced from the top and the bottom of the longitudinal bars and from each other so as to divide the longitudinal bars into thirds resulting in the best balanced arrangement for handling, strength and stability.

The foregoing is considered as illustrative only for the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An improved garment stretcher comprising three straight longitudinal bars, the first two being held in fixed spatial relationship by means of two straight cross bars permanently secured at each end to the first two longitudinal bars, these cross bars having a series of stepped adjustment means on their upper surface, the second or intermediate longitudinal bar having two openings therethrough, and a third longitudinal bar having two additional straight cross bars secured to it at one end of each, the free ends of these additional two cross bars extending through the said two openings in the second longitudinal bar to overlap the first-mentioned secured cross bars, the free end of each of the second said two cross bars having a depending cooperating means to interengage with the said series of stepped adjustment means on the secured two straight cross bars to provide lateral adjustment of the stretcher, means being provided for positively locking the cooperating interengaging means on the overlapping cross bars, said series of stepped adjustment means on the two secured cross bars comprising a series of spaced indentations, and the said depending cooperating means on the free end of each of the two overlapping cross bars comprises a detent member.

2. A garment stretcher as defined in claim 1 wherein the first-named permanently secured two cross bars are vertically spaced from each other the same distance that the two openings in the intermediate longitudinal bar are spaced from each other, and the two free ended cross bars are vertically spaced from each other for that same distance.

3. A garment stretcher as defined in claim 2 wherein the distance between the first opening in the intermediate longitudinal bar from the top of the said bar, and the distance between the other opening in the intermediate longitudinal bar and the bottom of the said bar is approximately one-third the length of the bar.

4. A garment stretcher as defined in claim 1 wherein the said means for positively locking the cooperating interengaging means on the overlapping cross bars comprises a resilient band.

5. A garment stretcher as defined in claim 1 wherein the detent members and the series of indentations are reinforced with metal.

6. A garment stretcher as defined in claim 1 wherein each member of the sets of overlapping cross bars are complementary to the other and together form cylindrical rods.

7. A garment stretcher as defined in claim 1 wherein all the bars are formed of plastic.

* * * * *